US006220184B1

(12) United States Patent
Sack

(10) Patent No.: US 6,220,184 B1
(45) Date of Patent: Apr. 24, 2001

(54) TRANSPORTABLE TABLE CART INCLUDING A ROTATABLE AND REMOVABLE TOP PORTION

(76) Inventor: Leon John Sack, P.O. Box 1009, East Point, FL (US) 32328

( * ) Notice: Subject to any disclaimer, the term of this patent is extended or adjusted under 35 U.S.C. 154(b) by 0 days.

(21) Appl. No.: 09/305,646

(22) Filed: May 5, 1999

(51) Int. Cl.[7] ..... A47B 11/00
(52) U.S. Cl. ..... 108/142; 108/139
(58) Field of Search ..... 108/139, 94, 77, 108/9, 142, 150; 248/156

(56) References Cited

U.S. PATENT DOCUMENTS

| | | | | |
|---|---|---|---|---|
| 288,408 | * | 11/1883 | Chew | 108/139 |
| 4,635,894 | | 1/1987 | Sammons | 248/558 |
| 5,535,684 | * | 7/1996 | John | 108/142 |

FOREIGN PATENT DOCUMENTS

| | | | |
|---|---|---|---|
| 2614190 | 10/1988 | (FR) | 108/77 |
| 1905 | 1/1908 | (GB) | 108/139 |
| 385144 | 12/1932 | (GB) | 108/139 |

* cited by examiner

*Primary Examiner*—Peter M. Cuomo
*Assistant Examiner*—Jerry A. Anderson
(74) *Attorney, Agent, or Firm*—Carnes, Cona, Dixon

(57) ABSTRACT

The present invention is a cart assembly comprising a top portion which is adapted to be removably secured to a lower portion. The top portion includes a rotatable table, known as a lazy Susan and secured to the rotatable table is a lock device, which enables the rotatable table to lock in a fix position when desired by the user. A removing device allows for the top portion to be removably secured to the bottom portion. This will render the top portion, when removed, to act as a tray for adequately and efficiently transport the finished product and to prevent handling by the user to intrinsically reduce damage thereto. The lower portion includes a plurality of legs. The legs, preferably includes lockable wheels to provide conveyance of the assembled assembly, when the top portion is secured to the bottom portion, or solely the bottom portion. The lower portion supports the top portion and is designed to aid the user. As such, a tray can be located between the plurality of legs, for consequently forming a storage means for the user.

19 Claims, 3 Drawing Sheets

TRANSPORTABLE TABLE CART INCLUDING A ROTATABLE AND REMOVABLE TOP PORTION

BACKGROUND OF THE INVENTION

1. Field of the Invention

The present invention relates generally to a transportable table cart, having a rotatable and removable top portion and more particularly to a table cart which is versatile, practical and one that is particularly suited for florists, cake decorators, crafters, and the like for easing their labor and inherently enabling efficient and exceptional work to be accomplished and allowing transportation of the finished product when utilizing the table cart of the present invention.

2. Description of the Prior Art

Rotatable tables are well known in the field and have been used in the bakery industry for cake decorating. These tables generally include a stand, having a lazy-Susan type structure located thereon, and wheels located at the bottom of the stand. For example, in U.S. Pat. No. 4,793,266 issued to Napolitano et al., there is disclosed a cake decorating stand wherein a handle extends upwardly from the lower portion. This provides for the final product to act as a transportable tray. Another feature in Napolitano et al., is that the stand can be raised or lowered. This allows the user adjust the table to a desired height so as to render a comfortable working environment. Though efficient, this assembly is limited in use, by providing an apparatus which, is only usable in the bakery industry. This apparatus is not adaptable to other fields, such as with floral designers, since the top portion, or lazy Susan is not removable from the assembly. Hence, the user risks the task of destroying and harming the finished product from the top portion.

Yet another apparatus is disclosed in U.S. Pat. No. 4,635,894 issued to Sammons. In this patent there's disclosed a multi-purpose furniture swivel assembly having a support secured to a swivel unit and a stand, having wheels located thereon. This stand is designed and configured for use with televisions, computer monitors, or the like, and is ideally suited for its intended purpose. However, this stand cannot be used in any type of creative environment since the swivel unit does not fully rotate, hence, limiting its use and accessibility. In addition, the stand is built so as to be obtrusive and to prohibit a comfortable working environment for one in a creative field, such as cake decorators, florists, crafter, or the like.

Hence, what is needed is an apparatus that will adequately and effectively enable a user a means of working in an efficient environment and allow for the finished product to be transported without the need to touch or move the finished product. This will ensure that the finish product remains in its pristine and original condition. Such an apparatus should be versatile, simple in construction so as to provide a device which is successful and that can be used with a minimal amount of training.

Accordingly, it is seen that none of these previous efforts provide the benefits intended with the present invention, such as identified above. Additionally, prior techniques do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention is an assembler conveyance cart assembly that is designed and configured to aid and assist those in creative fields, such as florists, bakers, crafters, and the like. The cart assembly of the present invention comprises a top portion that is adapted to be removably secured to a lower portion.

The top portion includes a rotatable table, known as a lazy Susan, which, preferably, includes a square like configuration. Secured to the rotatable table is a lock means, which enables the rotatable table to lock in a fix position when desired by the user. This top portion can further includes table extensions that are secured to the rotatable table, so as to permit for the table to increase in size and length.

A removing device allows for the top portion to be removably secured to the bottom portion. This will render the top portion, when removed, to act as a tray for adequately and efficiently transport the finished product and to prevent handling by the user to intrinsically reduce damage thereto.

The lower portion of the assembly of the present invention comprises a plurality of legs. The legs, preferably includes lockable wheels to provide conveyance of the assembled assembly, when the top portion is secured to the bottom portion, or solely the bottom portion. The lower portion supports the top portion and is designed to aid the user. As such, a tray can be located between the plurality of legs, for consequently forming a storage means for the user.

For further assistance, the apparatus of the present invention can include a removable handle, which is designed to be secured to the bottom portion. This handle will aid in transporting the unit to a desired location.

Accordingly, it is the object of the present invention to provide for an assembler cart which will overcome the deficiencies, shortcomings, and drawbacks of prior assembler carts and methods thereof.

Another object of the present invention, to be specifically enumerated herein, is to provide a transportable cart assembly in accordance with the preceding objects and which will conform to conventional forms of manufacture, be of simple construction and easy to use so as to provide a device that would be economically feasible, long lasting and relatively trouble free in operation.

Although there have been many inventions related to tables and stands having a rotatable portion, none of the inventions have become sufficiently compact, low cost, and versatile enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1A:
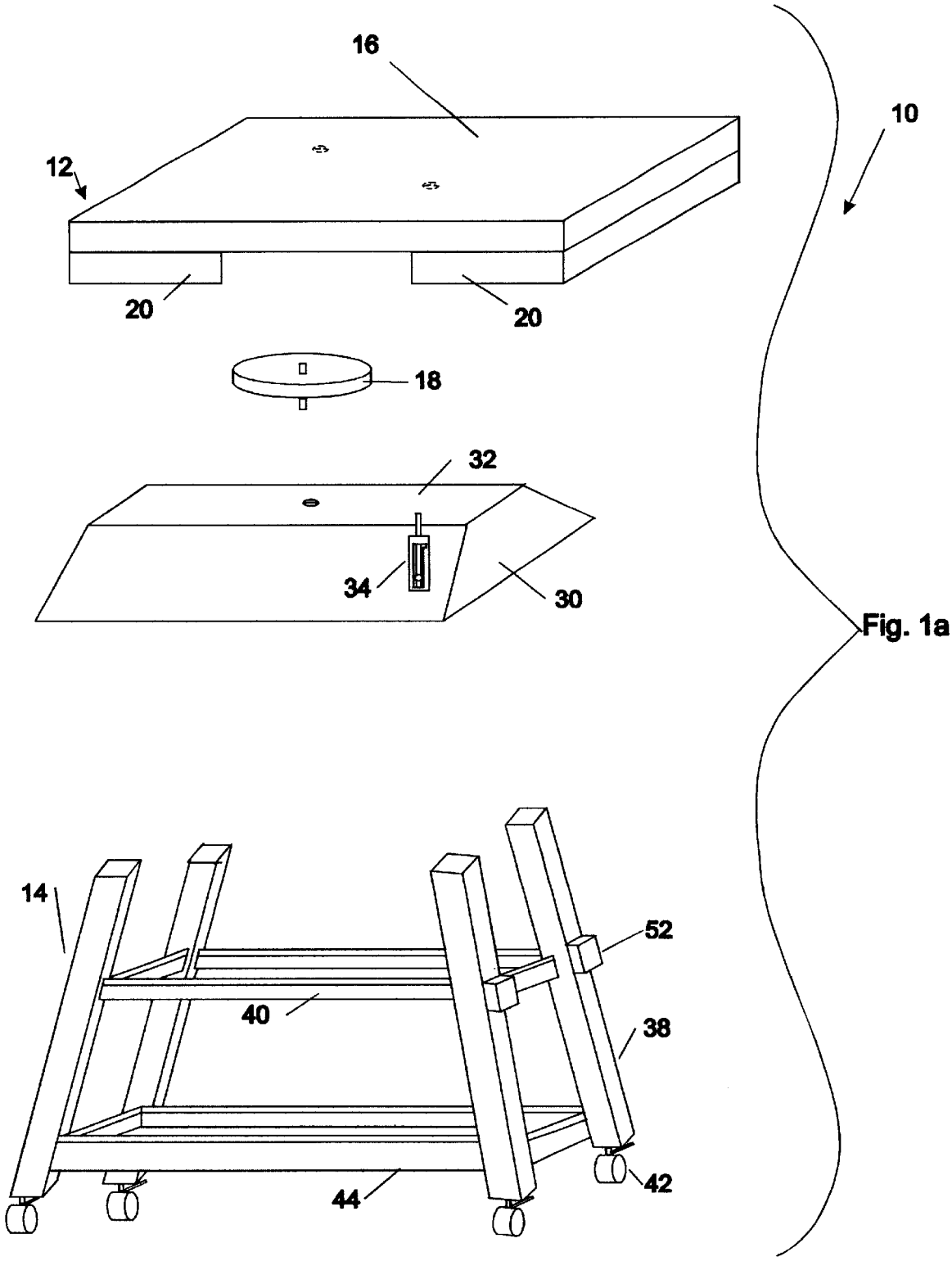
FIG. 1*a* is an exploded perspective view of the assembler cart of the present invention.
Figure 1B:
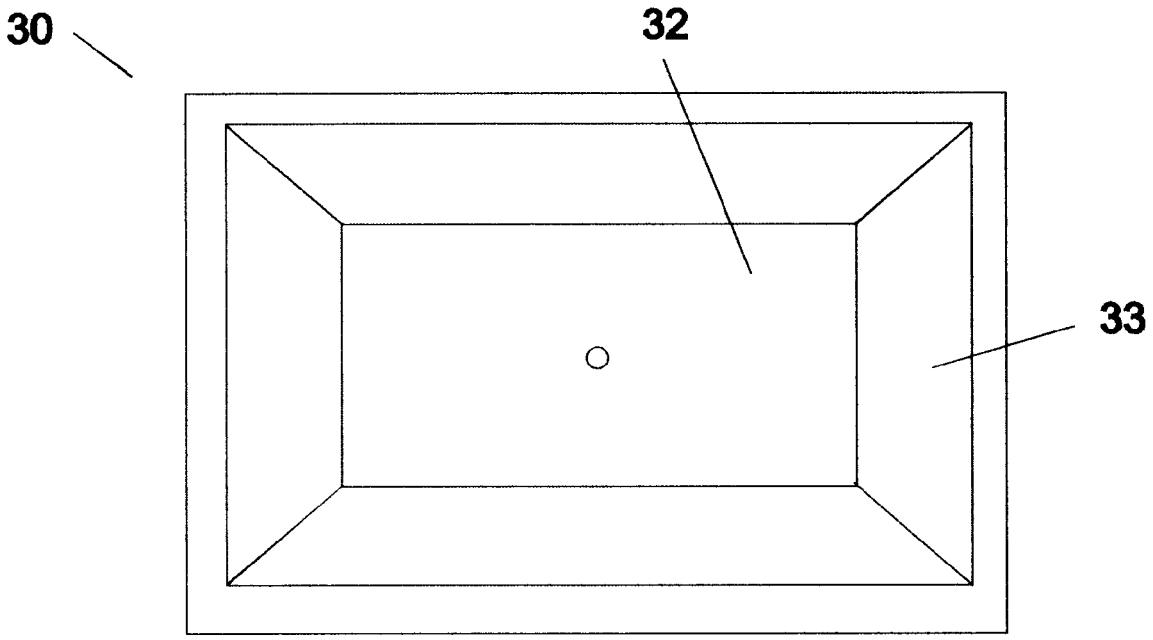
FIG. 1*b* is a bottom view of the brace used with the assembler cart of the present invention.

With reference to the drawings, in particular to FIGS. 1*a*–3 thereof, the assembler apparatus, generally denoted by reference numeral 10 will be described. The present invention can be used in a plurality of environments and situations, for enabling the viewing and accessibility of an item which is being created and fabricated. This invention has been used successfully in the florist industry, in particular when used when assembling flowers to be used during a funeral, especially those which are to be located on the casket. The assembler cart proved to be successful by inherently reducing time, labor, and damage to the final product, as done in previous situations, to adequately and efficiently: form floral arrangements; transport the arrangement to a vehicle; successfully place the arrangement by placing the top portion of the assembly in the vehicle, thus preventing harm to occur with the floral arrangement; and remove the floral arrangement via the top portion of the assembly from the vehicle to the desired location without marring or damaging the particular arrangement.

To allow for such an efficient transportation means and excellent accessibility to the item being formed, the present invention 10 comprises a top portion 12 removable secured to a bottom or lower portion 14. This top portion is removably secured to the lower portion, and thereby provides for the top portion to act as a transportation means as well as a support means, when used alone.

Assembly of the item being formed occurs at the top portion 12, and thus the top portion includes a support 16 that is mounted to a commercially and conventionally available rotatable disk 18, known as a lazy Susan. This attachment and arrangement will enable the support to rotate freely, when desired, to allow for all the sides of the item located on the support to be accessible to the user and builder, by enabling the user to merely rotate the support to the desired side. Hence, the support is a workable and rotatable table that can support any item that is being built thereon.

The support 16, preferably, includes a square like configuration and for situations where it is desirable to increase the work surface area, table extensions 20, are collapsibly secured to at least one side of the support. The collapsibility of the table extensions 20 provides for the final product which is not only customized to the desired needs of the user, but when collapsed (see FIG. 1*a*), is compact in size so as to provide for a device which is storable and manageable. To enable the table extensions 20 to be in a locked extended position (see FIG. 2) or in a stored folded position (see FIG. 1) conventional hinges 22, are utilized.

Figure 2:
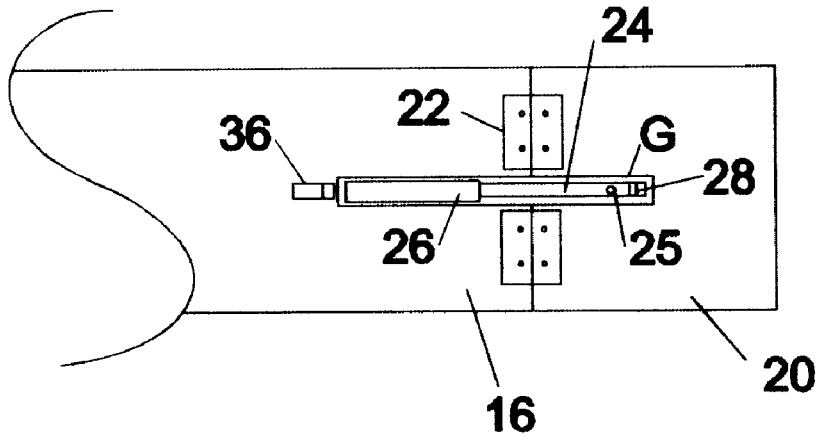
FIG. 2 is a bottom planar view of the extensions used with the assembler cart of the present invention.

For added stability, conventional slidable support rods 24 (illustrated in FIG. 2) can be located on under surface of the support 16 and lock into place to the under surface of the table extension 20. An example of one type of support rod which can be utilized is illustrated in FIG. 2. As seen in this figure, for each extension which is to be used, a sliding rod 24 is slidably secured in a tubular housing 26 located on the under surface of the support 16. This tubular housing is located in close proximity to each extension. This will provide for the housing 26 to maintain the rod 24 while still enabling the rod to slide freely within the housing. For permitting the sliding motion, a handle 25 is located on the rod 24. To lock the rod in a fixed and extended position, when it is desirable to use the table extension 20, a receiving device 28 is secured to the under surface of the table extension. Shown in this figure is a flexible hoop for receiving and maintaining the rod in the extended position. It is noted that any type or style of receiving device can be used.

The table extensions 20 can be located on any one side of the support 16, any two sides of the support, any three sides support or optionally, on all four sides of the support. The lower surface of the support 16 and extensions 20 can include a groove G or several grooves and indentations for the housing 26, rod 24, and receiving device 28 to provide for the lower surface to be flush and permit the extension to fold easily and adequately.

In the folded position, as seen in FIG. 1, the extensions can be locked in a fixed position via a holding device 36 (illustrated in FIG. 2). This holding device 36 is conventional and can be, as illustrated, a C-shaped flexible clip which receives and maintains the edge of the extension when in a folded position.

The rotatable disk 18 is rotatably secured to a brace 30. This brace 30 is designed and configured to be removable secured to the lower portion 14. To enable such an arrangement, the brace includes an enclosed top 32 and an open bottom 33 (illustrated in FIG. 1*b*). The rotatable disk 18 is secured to the enclosed top while the open bottom receives the lower portion 14 of the assembler device 10 of the present invention.

The final product is a brace that enables the top portion to be removably secured to the bottom portion 14. This will render the top portion 12, when removed, to act as a tray to adequately and efficiently transport the finished product and to prevent handling by the user to intrinsically reduce damage thereto.

The support 16 is versatile and it can be locked it in a fixed and secure position via a locking device 34. The locking device 34 can be any type or style of conventional locking devices and preferably is secured to the brace 30 and to the support 16. This structure will provide for the locking means to lock the support 16 to the brace 30, to inherently provide for the support to be in a fixed and secured position, and prevent rotation thereof. As seen in FIG. 1*a*, the locking device 34 comprises a conventional slidable lock having a shaft that is receivable into a hole (illustrated in outline, but not labeled). The holes will receive the shaft and thus allow for the device to be in a locked position. The use of two holes provides a device which can be locked in two positions, each being approximately 90 degrees from the other. Hence in one position, the support will be located linearly and parallel to the long edge of the brace, while in the second position, the support will be located in a perpendicular position along the long edge of the brace.

In an alternative embodiment, the support 16 can be eliminated, to provide for the rotatable disk 18 to act as the working surface or as the support. The disk 18 can include any configuration and can also have table extensions foldably secured to at least one side thereon. The use of rotatable disk as the support will innately decrease the number of components needed to successfully employ the invention.

When extensions are used with either the support or utilizing the rotating disk as the support, it may be necessary to provide for the rotating device to be removably secured to the brace 30. This is dependent upon the size of the enclosed top wall 32 of the brace. If enough clearance does not exists for the extension to be foldable lifted and lowered, then the rotating device will be removably secured to the brace. However, in the preferred embodiment, the top surface of the brace will be designed so as to enable the extension to fold and extend easily and efficiently and without being obtrusive. As seen in FIG. 1*a*, to enable the table extensions to extend outward, the user rotates the support 90 degrees to allow for the extensions to be folded outward.

As seen in FIG. 1*a*, the lower portion 14 of the assembler of the present invention 10, comprises a plurality of legs 38. To easily receive the upper portion 12, optionally, these legs 38 can be angularly disposed. As seen in FIG. 1*a*, the brace 30 is angularly disposed to provide for the surface area to increase in size from the enclosed top 32 to the open bottom and thus, the legs are angularly disposed to match the brace and securely maintain it thereon.

For added structural stability, cross bars 40 are secured across the legs of the lower portion 14. For mobility purposes, lockable wheels 42 can be secured to each leg of the lower portion. This will provide conveyance of the assembled assembly, when the top portion is secured to the bottom portion, or solely the bottom portion.

As seen in FIG. 1*a*, the lower portion 14 supports the top portion 12 and is designed to aid the user. As such, a tray 44 can be located between the legs 38, for consequently forming a storage means for the user. Optionally, this storage area can be enclosed.

Figure 3:
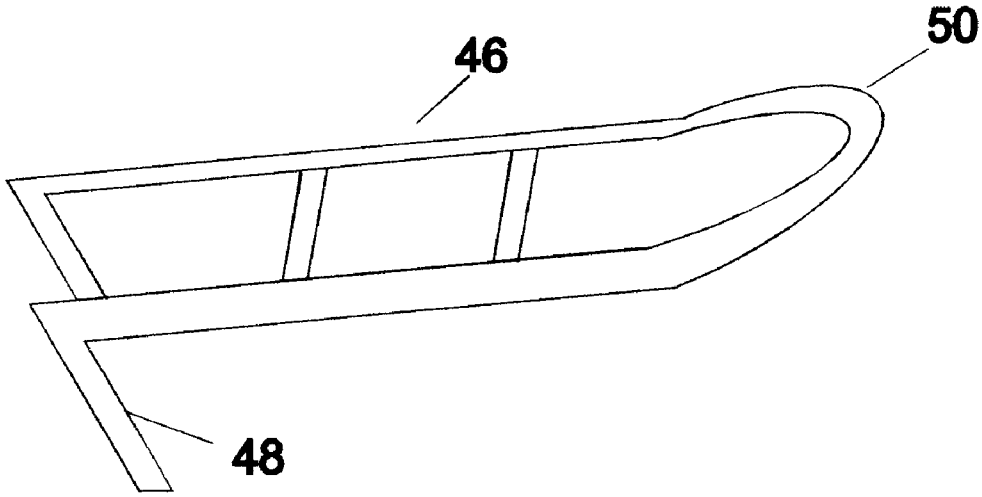
FIG. 3 is a perspective view of the handle used with assembler cart of the present invention.

For further assistance, the apparatus of the present invention can include a removably handle 46, illustrated in FIG. 3, which is designed to be secured to the bottom portion 14. This handle 14 will aid in transporting the unit to a desired location.

As seen in FIG. 3 the handle includes a front section 48 and a rear section 50. The front section 48 is removable secured to the lower portion 14 and the user manipulates the apparatus 10 via the rear section 50. To receive the front section 48, channels 52 are located on the legs of the lower portion 14. This arrangement allows for the front section 48 to slide into the channels 52 when desired to be used and slide out when not desired. Thus allowing the handles to slide into the channels provide for the securement of the device while removing the handle from the device provides for the removal therefrom. The device is naturally held into placed due to the angular displacement between the front section and rear section as seen in FIG. 3. Thereby, and as seen, the angular displacement between the front section and rear section provides for a natural stop between the channels and the handles. In use, the user inserts the front section into the channels. Once the top edge of the channels contacts the start of the rear section (at the point of the angular displacement) the handle is locked into place, and ready for use.

In an alternative embodiment, the handle can be permanently secured to the legs 38. The handle, in the permanent arrangement, can have any shape or configuration so as to provide for an assembler which can be manipulated efficiently by way of the particular handle.

Hence, the present invention is an apparatus which enables access to the work surface 16. The versatility of having a rotatable work surface 16 provides a final product which is user friendly by providing a work surface which is movable and non-tedious to the user. The rotatable work surface allows accessibility of the item being formed thereon at all angles. The locking device 34 prevents the work surface from rotating when desired.

The removable top portion provides a device where the item located on the work surface 16 can be stored easily and conveniently, without disrupting or destroying the item located thereon.

The assembler cart 10 illustrated in FIGS. 1*a*–3 has been utilized and proven to be successful, especially when designing and forming floral arrangements. In use, the floral arrangement is formed on the work surface 16 and is at a height convenient to the user by being located on the lower portion 14. Once formed, it is transported, still on the support 16 which is affixed to the lower portion 14, to an automobile or the like. The upper portion 12 is lifted off the lower portion 14 and placed in the automobile for transportation, thus preventing harm to occur with the floral arrangement. Once at the desired location, the floral arrangement is removed from the support and to its final designation. This apparatus drastically reduces the chance and possibility of marring or damaging the particular arrangement by reducing physical contact between the florist and the floral arrangement.

While the invention has been particularly shown and described with reference to an embodiment thereof, it will be understood by those skilled in the art that various changes in form and detail may be made without departing from the spirit and scope of the invention.

I claim:

1. A transportable table cart comprising:

a top portion;

a lower portion;

said top portion is removably secured to said lower portion;

a support;

a rotating device;

a brace;

said rotating device is sandwiched between said support and said brace and said rotating device is secured to said support and said brace;

said rotating device enables said support to rotate freely when desired;

said brace includes an enclosed top and an opened bottom and said open bottom receives said lower portion for providing for said top portion to be removably secured to said lower portion;

said support, said brace and said rotating device constitute said top portion;

said brace acts as a stand device and support device when removed from said lower portion; and a lock device is secured to said brace and said and is removably lockable to said support for preventing movement of said rotating device.

2. A transportable table cart as in claim 1 wherein at least one collapsible table extension is secured to said support, said at least one collapsible table extension when in an extended position increases work surface of said support.

3. A transportable table cart as in claim 1 wherein said lower portion include a plurality of legs to provide for transportability of said cart.

4. A transportable table cart as in claim 3 wherein a handle is removably secured to said lower portion.

5. A transportable table cart as in claim 1 wherein said lower portion includes a tray for added storage.

6. A transportable table cart comprising:

a top portion;

a lower portion;

said top portion is removably secured to said lower portion;

a support;

a rotating device;

a brace;

said rotating device is secured to said support and said brace;

said rotating device enables said support to rotate freely when desired;

said brace is removably secured to said lower portion;

said support, said brace and said rotating device constitute said top portion;

said brace acts as a stand device and support device when removed from said lower portion; and said brace includes an enclosed top and an opened bottom, said open bottom receives said lower portion to provide for said top portion to be removably secured to said lower portion.

7. A transportable table cart as in claim 6 wherein said lower portion includes a tray for added storage.

8. A transportable table cart as in claim 6 wherein at least one collapsible table extension is secured to said support, said at least one collapsible table extension when in an extended position increases work surface of said support.

9. A transportable table cart as in claim 6 wherein said lower portion include a plurality of wheels to provide for transportability of said cart.

10. A transportable table cart as in claim 9 wherein a handle is removably secured to said lower portion.

11. A transportable table cart as in claim 6 wherein a locking device is secured to said support and said brace to enable said support to be in a fixed and locked position.

12. A transportable table cart comprising:

a top portion;

a lower portion;

said top portion is removably secured to said lower portion;

a support;

a brace;

said support is rotatably mounted to said brace;

said brace is removably secured to said lower portion;

said support and said brace constitute said top portion;

said brace includes an enclosed top and an opened bottom, said open bottom receives said lower portion;

said enclosed top is smaller in surface area than said open bottom to provide for outwardly extending sides;

said brace is a free standing unit; and said brace acts as a stand device and support device when removed from said lower portion.

13. A transportable table cart as in claim 12 wherein said brace includes a top surface and a lower surface, said top surface includes a surface area smaller in size than said lower surface for providing stability to said brace.

14. A transportable table cart as in claim 12 wherein at least one collapsible table extension is secured to said support, said at least one collapsible table extension when in an extended position increases work surface of said support.

15. A transportable table cart as in claim 12 wherein said lower portion include a plurality of legs having lockable wheels secured thereto to provide for transportability of said cart.

16. A transportable table cart as in claim 15 wherein a handle is removably secured to said lower portion.

17. A transportable table cart as in claim 12 wherein a locking device is secured to said support and said brace for enable said support to be in a fixed and locked position.

18. A transportable table cart as in claim 12 wherein said lower portion includes a tray for added storage.

19. A transportable table cart as in claim 14 wherein each table extension includes a locking rod assembly for locking said table extension in a fixed position when extended.

* * * * *